US005257590A

United States Patent [19]

Foote, Jr. et al.

[11] Patent Number: 5,257,590

[45] Date of Patent: Nov. 2, 1993

[54] CANOE SADDLE AND SPRING STRIP SECUREMENT MEANS

[76] Inventors: Robert H. Foote, Jr., Rte. 1, Box 183; Charles C. Holt, Rte. 3, Box 134A; Joseph E. Mankins, Rte. 1, Box 209, all of Cleveland, Okla. 74020; George D. Stewart, 1375 Florida Rd., Durango, Colo. 81301

[21] Appl. No.: 928,894

[22] Filed: Jan. 16, 1992

Related U.S. Application Data

[63] Continuation of Ser. No. 558,801, Jul. 27, 1990, abandoned.

[51] Int. Cl.[5] ..... B63B 17/00

[52] U.S. Cl. ..... 114/347; 114/343; 114/363

[58] Field of Search ..... 114/347, 363, 343, 364; 297/195, 429, 431

[56] References Cited

U.S. PATENT DOCUMENTS

| | | | |
|---|---|---|---|
| 255,265 | 3/1882 | Fearon | 114/363 |
| 285,981 | 10/1883 | Douglas | 114/363 |
| 710,147 | 9/1902 | Goodwin | 114/363 |
| 859,582 | 7/1907 | Rosin | 114/363 |
| 1,346,869 | 7/1920 | Yelle | 114/347 |
| 2,033,637 | 3/1936 | Kaiser | 114/363 |
| 2,483,531 | 10/1949 | De Boisblanc | 114/347 |
| 2,522,910 | 9/1950 | Wayne | 114/363 |
| 2,815,517 | 12/1957 | Andresen | 114/363 |
| 3,639,933 | 2/1972 | Trowbridge | 114/363 |
| 3,958,289 | 5/1976 | Carlson | 114/363 |
| 4,380,208 | 4/1983 | Goserud | 114/363 |
| 4,398,488 | 8/1983 | Mathieu | 114/363 |
| 4,407,216 | 10/1983 | Masters | 114/363 |
| 4,411,214 | 10/1983 | Horiuchi | 114/363 |
| 4,503,799 | 3/1985 | Masters | 114/363 |
| 4,669,992 | 6/1987 | Morris | 297/195 |
| 4,739,720 | 4/1988 | Jarschke | 114/347 |
| 4,744,327 | 5/1988 | Masters | 114/347 |
| 4,773,709 | 9/1988 | Slinkard | 114/363 X |
| 4,942,840 | 7/1990 | Masters | 114/363 |
| 5,013,270 | 5/1991 | Walls | 441/45 |
| 5,061,215 | 10/1991 | Walls | 114/363 |

OTHER PUBLICATIONS

Mad River Canoe, 1988 Catalog, p. 18.

Four Corners Marine, the white water store, 1988 Catalog, p. 6.

*Primary Examiner*—Sherman Basinger

*Attorney, Agent, or Firm*—Kenton L. Freudenberg; Maxwell C. Freudenberg

[57] ABSTRACT

A saddle assembly for use in canoes or similar craft comprising a hollow, watertight rotationally molded structure with a sealable accessible interior compartment, secured to the craft at or near the base surface of the saddle by use of a plurality of anchors adhered to the canoe hull or by use of flexible spring strips which are capable of conforming to the cross sectional shape of virtually any hull and which provide easy removal and installation of the saddle in different positions. The saddle is provided with thigh straps, to help secure the paddler into the craft, which pass over the paddlers thighs, one end of which is attached to the saddle and the other is attached to the hull of the craft. Footbraces which are adjustable longitudinally are affixed along a lower edge of the saddle. The exterior of the saddle is provided with recesses molded in place to hold various common accessories including water bottles, dry storage boxes, and rescue lines so that they are available to the paddler.

32 Claims, 8 Drawing Sheets

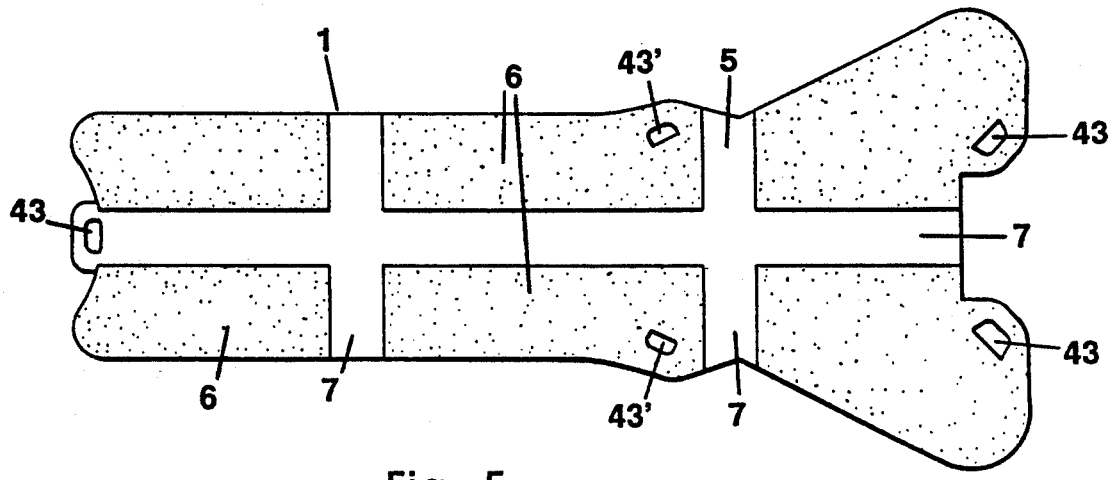
Fig. 5
Fig. 6
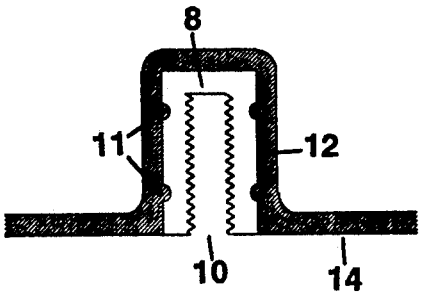

CANOE SADDLE AND SPRING STRIP SECUREMENT MEANS

This application is a continuation of abandoned application Ser. No. 07/558,801 filed Jul. 27, 1990.

BACKGROUND OF THE INVENTION

The sport of canoeing, and whitewater canoeing in particular has evolved to the point where paddlers are commonly running extremely turbulent whitewater and very difficult rapids which often include severe drops. In order for a paddler to be comfortable and secured sufficiently in a canoe in a paddling position for the purpose of controlling the craft in turbulent water and/or righting the craft if it should capsize, it has become common for paddlers to use a structure such as a saddle shaped from semi-rigid plastic foam to specifically fit a particular paddler. Such a saddle allows the paddler to adopt a generally kneeling position, straddling and sitting on the saddle with straps passing over the thighs to help hold the paddler securely in place but without risk of becoming trapped should it be desirable to exit the craft for any reason.

Because of the variation in size and shape of canoes of different manufacturers as well as the variation in size of the paddlers, it has heretofore been difficult to readily adapt a common saddle structure to the different craft and individuals. U.S. Pat. No. 4,503,799 to Masters shows a relatively rigid saddle structure which provides integral fixed and non-releasable braces over the paddler's legs. While such a saddle can be fitted to an individual through the use of additional padding or filler material glued in place, the saddle itself provides no inherent adjustability for different paddlers. The Masters saddle is further limited by being secured to the canoe by attachment to cross braces or thwarts located generally above the saddle and usually at the level of the gunnels of the craft. Since the height of the gunnels can vary from one craft to another, the Masters saddle generally requires that either the saddle, the cross braces or both be adapted to allow securing the saddle into various craft. Also, since a thwart is typically an immovable and integral part of a canoe structure, the fore and aft location of the thwarts may largely dictate the position of a saddle which is to be secured to the thwarts. This may inhibit placing the saddle in a location to achieve the best possible trim of the craft. Additionally, while Masters provides a hollow structure with a port which provides access to the interior for storage, the port which Masters uses for access to the interior is located on the side or rear of the saddle and does not provide the convenience of access which is available in the port of the present invention which is located on the top surface of the saddle just behind the paddler.

SUMMARY OF THE INVENTION

The structure of the present invention provides a hollow watertight accessory canoe saddle assembly and a means of securing an accessory saddle or any other accessory object into a canoe or other watercraft which is existing and has a structurally complete and open hull which is rigid and/or of predefined shape, regardless of its hull configuration. The structure also provides for complete adjustability of the thigh straps and footbraces of the saddle assembly itself so that it may be quickly adapted to different paddlers in the same craft. Because the saddle assembly is not dependent on being attached to thwarts or other cross members the base of the rigid watertight buoyant hollow saddle body may be placed and releasably anchored at virtually any position in a craft for any purpose, including that of providing the best possible trim, either side to side or fore and aft, of the craft in the water. The releasable securement means which enables such fore-to-aft or side-to-side trim adjustments of the saddle assembly within the hull comprises attachment points which are located only along an elongated narrow area of the lower base surface of the saddle body which rests on an elongated narrow area of the hull floor area. These elongated narrow areas have a maximum width essentially equal to the spacing between the knees of a paddler in a kneeling paddling position straddling the saddle assembly. Such securement locations leave the hull floor area and any saddle anchoring devices thereon exposed along opposite sides of the straddled portions of the saddle assembly and provide substantial room at either side of the saddle assembly to allow side-to-side trim adjustments. Additionally, the present saddle features holders to provide a paddler in the paddling position with easy access to such necessary items as water bottles, waterproof storage containers and emergency throw lines as well as interior dry storage of any other desirable items. The saddle assembly is further capable of being moved from one craft to another so that a user of several canoes need only use one saddle assembly and its attached equipment for the different craft. The securing and adjustment of the saddle assembly, or its removal, relative to the existing watercraft with which it is used, do not in any way affect the structural integrity or completeness of the watercraft.

In canoe saddles made of various plastic foams such as "Ethafoam" polyethylene foam of or "Minicell" poly-vinyl chloride foam, the lack of stiffness or structural integrity of the foam material does not readily allow mechanical fasteners to be attached directly to the saddle. The method of securement of such saddles into a hull is best exemplified by prior art foam saddles in which the entire lower surface of the saddle is non-removably adhered to a hull with a suitable adhesive.

While removability of the saddle assembly is desirable to provide for its portability from one craft to another, it is also desirable, to allow the saddle to be easily repositioned or adjusted within a given craft, longitudinally or laterally with respect to the craft, as may be necessary to create a proper trim of the boat when compensating for the weight of cargo or passengers. The removability of the saddle also allows space normally occupied by the saddle and paddler to be freed for carrying cargo. To best accomplish this, it is desirable to have a means of securing the saddle to the canoe which is either completely removable along with the saddle or which is as unintrusive as possible-when the saddle is removed. It is an added benefit if the means for securing the saddle can also be used to secure gear into the craft as is generally desirable to prevent the loss of unsecured gear should the craft be capsized, swamped or merely subjected to the normal turbulence encountered in paddling whitewater.

The use of a watertight hollow saddle body provides the further benefits of providing additional buoyancy to the craft should it become swamped or capsized. By providing a port with a sealable closure to allow access to the interior of the saddle body, the interior space can also be used for the storage of gear, and is particularly useful for loose items or items which must be kept dry. Because the saddle is secured to a craft at or near its lower surface, its upper surface can be free of any interfering thwarts or other hardware, allowing the port to be located directly on its upper surface. This provides great convenience in gaining access to the interior of the saddle and in viewing the contents of the saddle, particularly when the saddle is in place in a canoe and space to the sides or behind the saddle may be limited.

A common accessory used by whitewater paddlers is a rescue line stored in a throwable bag and which can be used for any of a number of purposes which may require one individual to extend such a line to assist another. This would typically be desirable where a paddler has capsized his or her craft and is left swimming in rough water where the use of such a safety line can facilitate getting the swimmer to shore. Obviously, in many such situations it is highly desirable to have a throw line quickly and readily available, yet have it positioned so that it is not in the way when it is not needed. To provide for such availability, the rear of the present saddle is provided with a vertical surface which is concave about a vertical axis, creating a slightly recessed area into which a throw line can be secured with straps or elastic "bungee" cords.

It is an object of the present invention to provide an improved canoe saddle with thigh straps and foot braces which are fully adjustable in length to accommodate different paddlers.

It is another object of the present invention to provide an improved canoe saddle which has improved lateral bracing of the paddler's thighs and knees to provide enhanced stability of the paddler in the canoe.

It is also an object of the present invention to provide a canoe saddle which provides a means of securing commonly used accessories such as water bottles, rescue lines and dry storage boxes so that they may be readily accessible to a paddler.

It is another object of the invention to provide an improved canoe saddle structure which facilitates rotational molding of the saddle.

It is an object of the present invention to provide an improved canoe saddle which is hollow and watertight to provide interior dry storage for cargo items and additional buoyancy in a capsized craft.

It is a further object of the present invention to provide a watertight, hollow saddle structure in which cargo may be stored and in which access to the interior compartment is through an opening located on the top of the structure for maximum convenience.

It is another object of the present invention to provide a canoe saddle which is readily movable to allow a single saddle to be used in a number of different craft.

It is another object of the present invention to provide a canoe saddle which is readily removable to allow the space normally occupied by the saddle to be made available for carrying cargo.

It is another object to provide a means of securing a saddle into a canoe, with the securement means being readily adaptable to a wide variety of hull shapes and configurations It is another object to provide a means of removably securing a saddle into a canoe which is unintrusive when the saddle is removed.

It is another object to provide a means of removably securing a saddle into a canoe which may also be used for other purposes such as securing cargo into the craft.

DESCRIPTION OF THE DRAWINGS

FIG. 5 is a plan view of the preferred embodiment from the underside showing channeled plastic foam material on the lower surface of the saddle.

FIG. 6 is a cross sectional view of a threaded insert molded into the plastic of the saddle to provide an anchoring point for the various accessories which may be attached to a saddle.

DESCRIPTION OF THE PREFERRED EMBODIMENT

Figure 1:
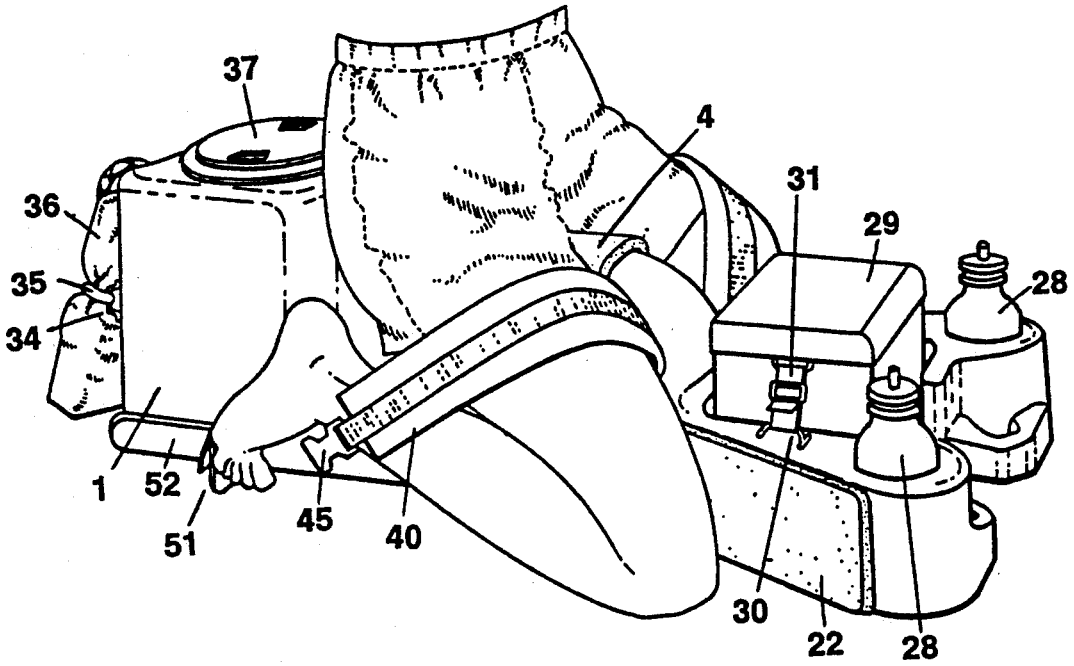
FIG. 1 is a perspective view of the saddle of the preferred embodiment showing a paddler in paddling position.

The saddle body 1 of the preferred embodiment is a hollow structure of linear or crosslinked polyethylene plastic material formed by using a rotational molding process. During this rotational molding process, a heated female mold cavity is rotated about several axes to allow molten plastic within the mold to flow completely over the interior mold surface to form a relatively thin molten layer of plastic which, when cooled and solidified, forms the durable rigid shell of the molded hollow body structure. The seat portion 2, located on the upper surface of the saddle body, is straddled by the paddler as shown in FIG. 1 and has a smooth rounded upper surface of generally semicircular cross section to provide a comfortable surface upon which the paddler sits. This seat portion 2 can be covered with a soft closed cell plastic foam cushioning material 4, adhered in place with a suitable waterproof adhesive, to provide even greater comfort for the paddler. The lower surface or base 5 of the saddle body is generally flat to give it the greatest possible stability as it rests upon the interior "floor" surface area of the canoe which is typically generally parallel to the surface of the water upon which the canoe floats. A layer of closed cell polyethylene foam material 6, available under the name "Ethafoam", approximately one inch in thickness is adhered to the base with a suitable waterproof adhesive. To provide maximum stability of the saddle, where this foam layer is used, the foam layer covers most of the periphery of the base surface. This additional layer of foam may be formed, cut away or shaped as necessary to allow its lower surface to conform to the hull 3 of the craft, particularly where the hull configuration has some curvature either side to side or front to back in the area beneath where tho saddle will be located. The compressibility of the foam not only helps adapt the saddle to fit different hulls which have slightly different curvatures, but also provides some ability for the hull in the area beneath the saddle to deform under impact with, for example, a submerged rock, absorbing the force of the impact and helping prevent permanent damage to the hull. The foam layer 6 is provided with channels 7 open toward the lower surface and extending both longitudinally and transversely to allow the free passage of water under the saddle. This insures that any water which may be taken on and accumulated in the hull is able to flow continuously to the lowest point in the hull where it can be easily removed by using a pump, scoop, bucket or sponge. Also, by permitting such water to flow freely, the stability of the craft is less likely to be affected by an accumulation of water in an area where the excess weight may adversely affect the balance or trim of the craft.

Mounting inserts 8, as shown in FIG. 6, for the attachment of accessories to the saddle body are positioned within the saddle mold prior to the molding process. Each insert 8 is approximately ½ inch in depth and ⅜ inch in width and comprises an elongated internally threaded brass or aluminum hexagonal nut with one open end 10. These nuts are sometimes pre-coated with plastic material before being molded into the saddle. The multi-faceted exterior hexagonal surface of these nuts is provided with circumferential grooves 11 to enhance the engagement of the plastic material 12 of the saddle with the exterior of the nut, thereby anchoring the nuts securely within the wall of the molded saddle. The inserts are held in position on the interior of a mold and are encased by the molten plastic of the saddle during molding to become an integral part of the cured plastic saddle structure with their open ends opening outwardly and generally flush with the exterior surface 14 of the saddle. Larger and stronger versions of these inserts may also be used to anchor the saddle assembly itself.

The forward portion 20 of the saddle body, against which the paddler's knees rest is widened in relation to the remainder of the body by flaring it outward laterally. Because of the wider flared area, a paddler can adopt a position with the inside of the knees braced against opposite sides of the saddle body yet spread or spaced apart. The forward portion of the flared area of the saddle, where its outwardly extending wing portions 25 are supported by the hull, is essentially double the width of the base of the saddle at the area of the centrally located seat portion. The resulting wider bases of both paddler and saddle provide more stability for each respectively and a resultant greater control of the craft. The generally vertical sides 21 of the flared area which are in contact with the paddlers's knees can be padded for comfort by adhering a suitable foam material 22 in place with a suitable waterproof adhesive. The flared area is provided with upwardly opening recesses 23 and 24 for holding commonly used accessories and which are self-draining to prevent the undesired accumulation of water. Two vertical generally cylindrical recesses 23 which are open at top and bottom, are located at the outer and forward wing portions of the flared area. The generally vertical walls sides of these recesses are tapered very slightly inward toward their bottom and are used for frictionally holding plastic water bottles 28 of a type commonly used for bicycling. A rectangular trough 24 is located in the forward center portion of the flared area to snugly receive a commonly available watertight box 29, to provide dry storage which is readily accessible to the paddler. This rectangular trough is open at its forward end to allow complete drainage of any water which may enter between the watertight box and the trough. At each of the laterally opposite sides of the trough, the upper surface of the saddle body is provided with a strap anchoring means 30 known as a "footman's loop" so that the box may be secured in place with nylon straps 31. A typical such watertight box is provided with a latchable hinged lid which, when unlatched, is free to swing open to provide access to the interior of the box. The box is also fitted at each side and below the lid with strap anchor means which is used in conjunction with the nylon strap 31 and the footman,s loop located on the saddle to strap the box 29 in place without interfering with the hinging movement of the box lid to gain access while the box remains secured to the saddle. In order to provide for the most efficient use of the limited upper surface area of the flared portion of the saddle, each cylindrical recess 23 is positioned with its center forward of one of the forward corners of the rectangular trough and out to the side on a line therefrom at an angle of approximately 45 degrees. Additionally, sufficient space must be maintained within the saddle body between the walls of the cylindrical recesses 23 and the adjacent corner of the rectangular trough 24 to allow molten plastic to flow therebetween during the molding process.

The generally vertical rear surface of the saddle body is concave about a vertical axis to create a slightly recessed area 33 into which a rescue line in a throw bag can be conveniently secured. One footman's loop 34 is positioned at each side so that a single strap or elastic cord 35 can be used to hold the throw bag 36 in place.

Figure 7:
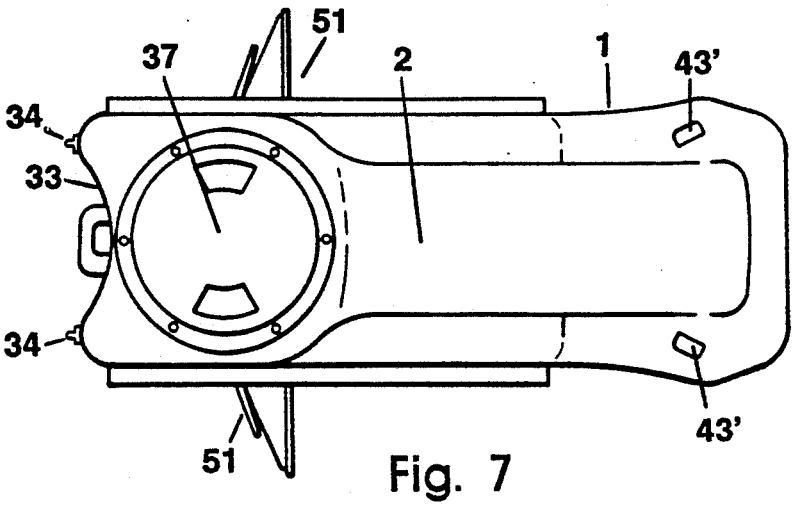
FIG. 7 is a plan view of a shortened saddle for use in the bow of a canoe.
Figure 8:
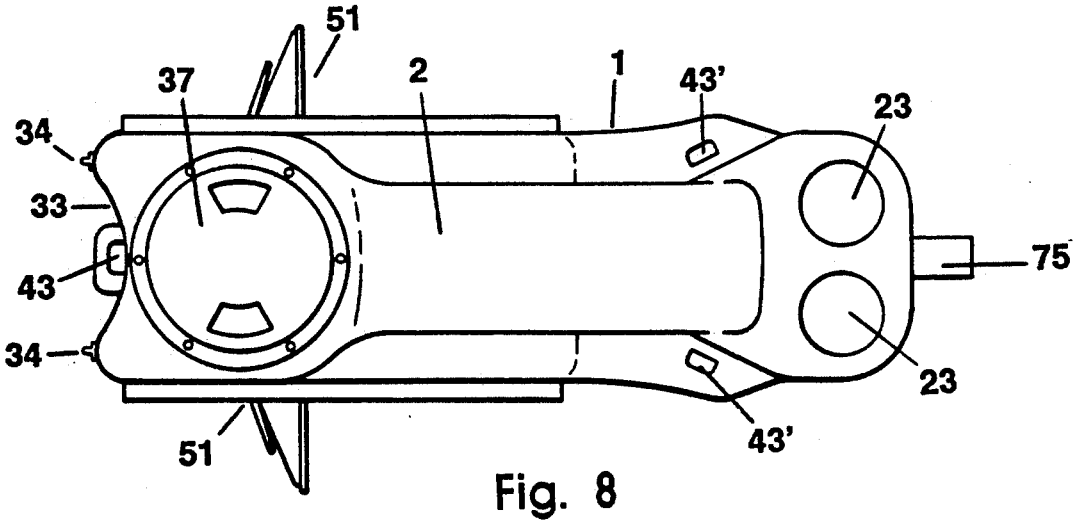
FIG. 8 is a plan view of a shortened saddle for use in the bow of a canoe, with recesses for holding water bottles.
Figure 9:
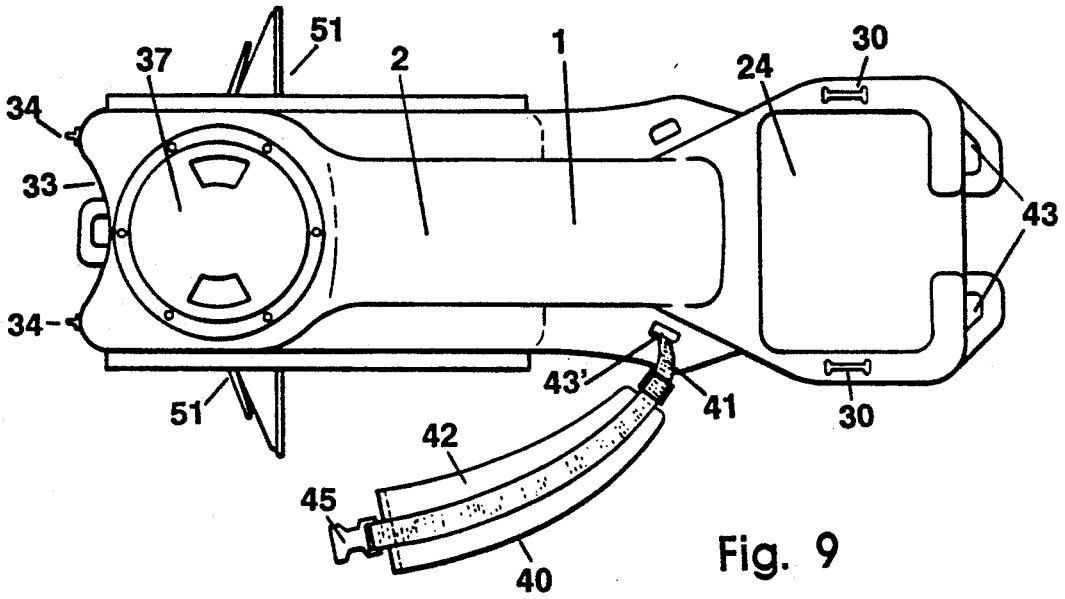
FIG. 9 is a plan view of a shortened saddle for use in the bow of a canoe, with a recess for holding a dry box.

Alternatively, it may desirable to use such a saddle in the narrow bow of canoe where space is limited because of the convergence of the craft's sides. For such use, the saddle can be constructed without the outward flared portion and shortened in length as shown in FIGS. 7, 8, and 9.

Figure 13:
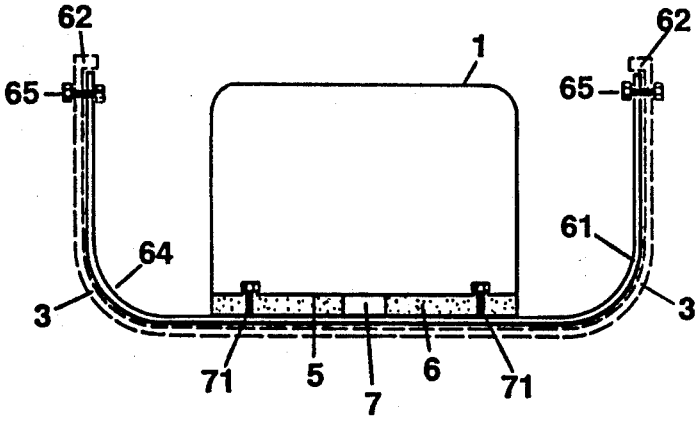
FIG. 13 is a cross sectional view showing a spring strip anchoring means for securing a the saddle into a craft as it would appear in place within a canoe hull.

Immediately behind the paddler on the upper surface of the saddle is an upwardly facing opening forming a watertight port 37 with a sealable removable cover or closure which threads into place. The port 37 provides just behind and above the seat portion 2 a sealable opening which, when opened, allows access to the dry cargo storage area on the interior of the saddle body. As seen in FIG. 13, the upper surface of the saddle is at approximately the height of the gunnels 62.

Figure 3:
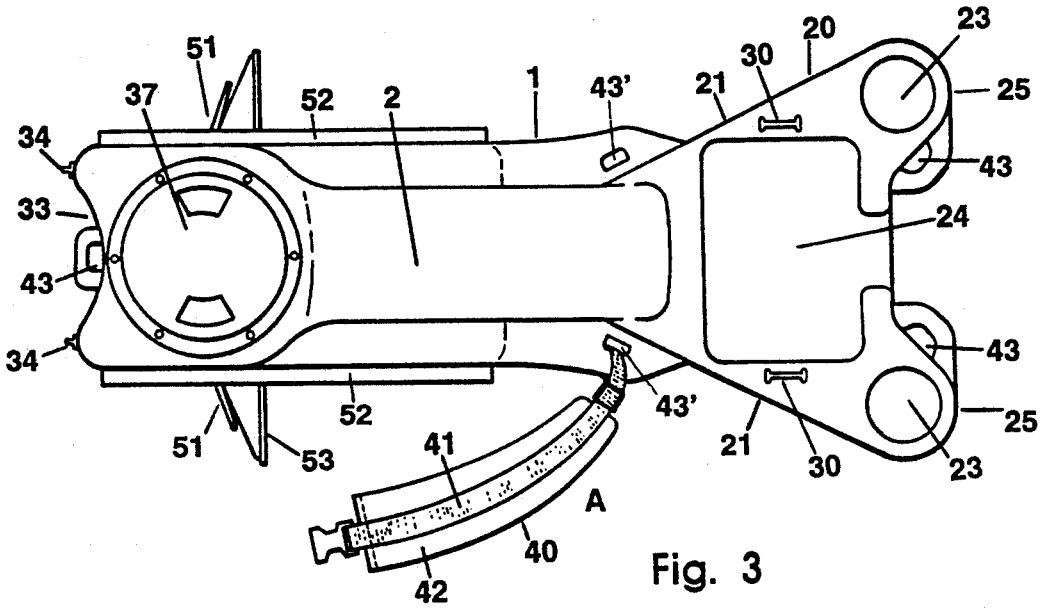
FIG. 3 is a plan view of the preferred embodiment.
Figure 4:
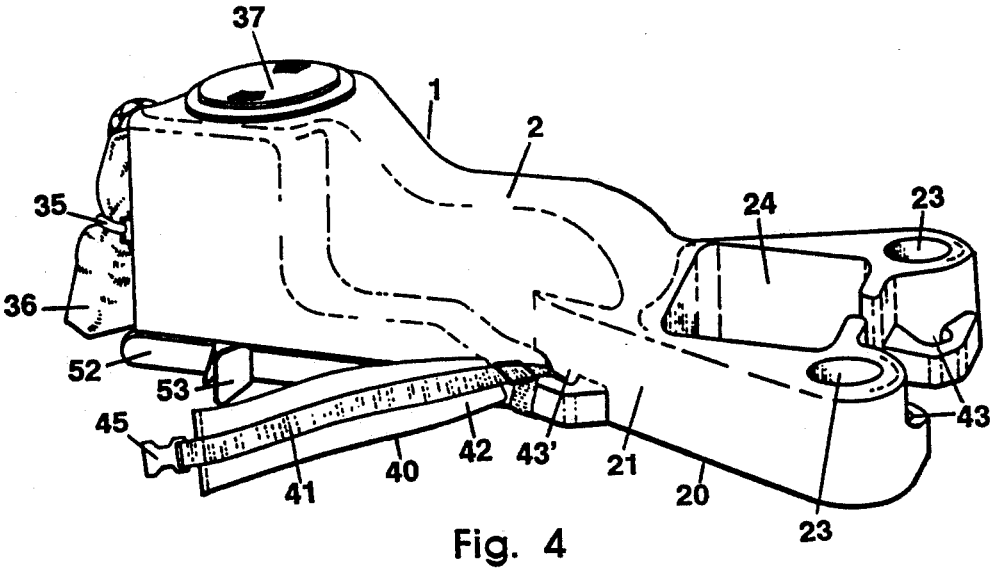
FIG. 4 is a perspective view of the saddle of the preferred embodiment without cushioning and part of the accessories.
Figure 16:
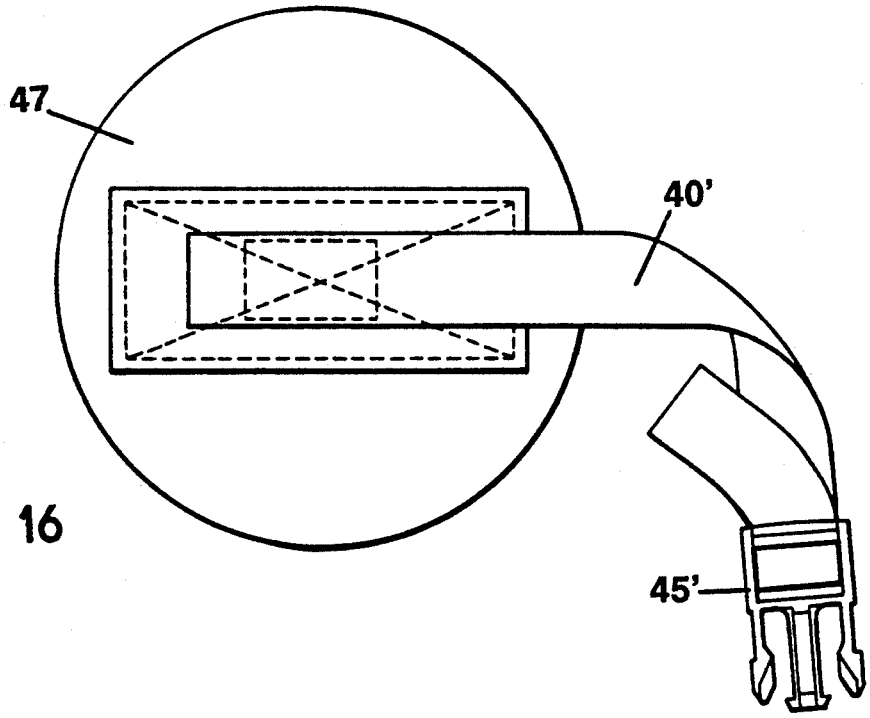
FIG. 16 is a plan view of a PVC patch with a strap and buckle portion used to secure one end of a thigh strap to the hull of the craft.
Figure 18:
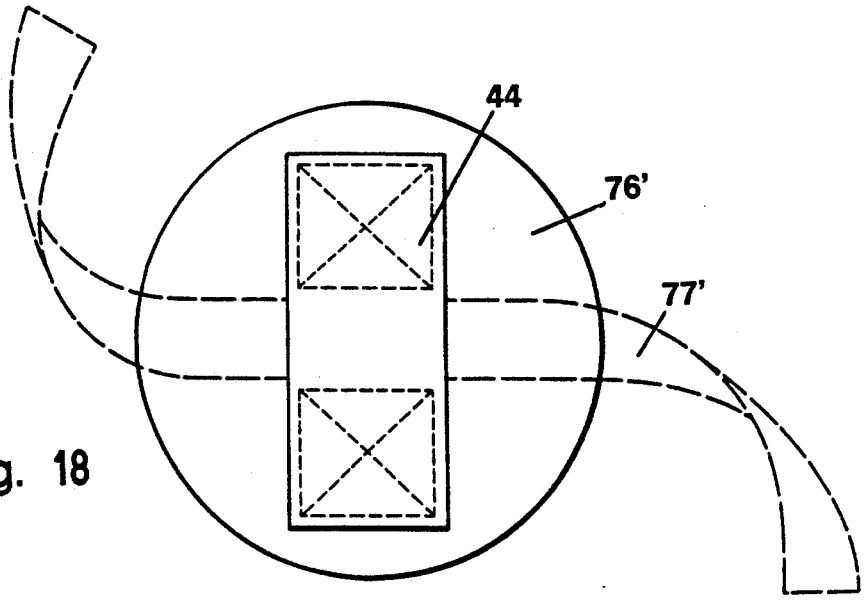
FIG. 18 is a plan view of a PVC patch and web assembly similar to that shown in FIG. 17, but in which a removable anchoring strap may be used.

Flexible thigh straps 40 made of nylon webbing 41 and provided with padding material 42 for comfort, are secured to the saddle by passing one end through an eye 43' at a side of the saddle. These straps 40 extend over the paddler's thighs to an attachment point on the inside surface of the canoe hull located to the side of the paddler. Each strap is comprised of two portions 40 and 40' which are separable lengthwise so that the saddle assembly, when otherwise not secured to the hull, may be readily detached completely from the hull. The length of the strap is made adjustable through use of commonly available buckles which provide frictional securement of the strap. Such buckles comprise two separable parts 45 and 45' which provide the separability of the straps as described above. A strap attachment point on the hull is most conveniently made using a round patch of reinforced PVC material 47 as shown in FIG. 16, with a strap portion 40' permanently sewn in place and provided with a buckle portion 45'. To reduce the intrusion within the canoe when the strap is removed, a small rectangular web 44 may be sewn to the round patch at spaced points to provide a passage beneath the web for removably securing a strap as shown in FIG. 18. The PVC patch is adhered to the hull of the craft with a suitable waterproof adhesive. The thigh straps themselves are constructed from nylon webbing 41 sewn to a foam padding and provided with a curve which is generally concave toward the paddler, as shown most clearly in FIG. 3. at A, to help facilitate the retention of the straps in position over the paddler's thighs.

Figure 2:
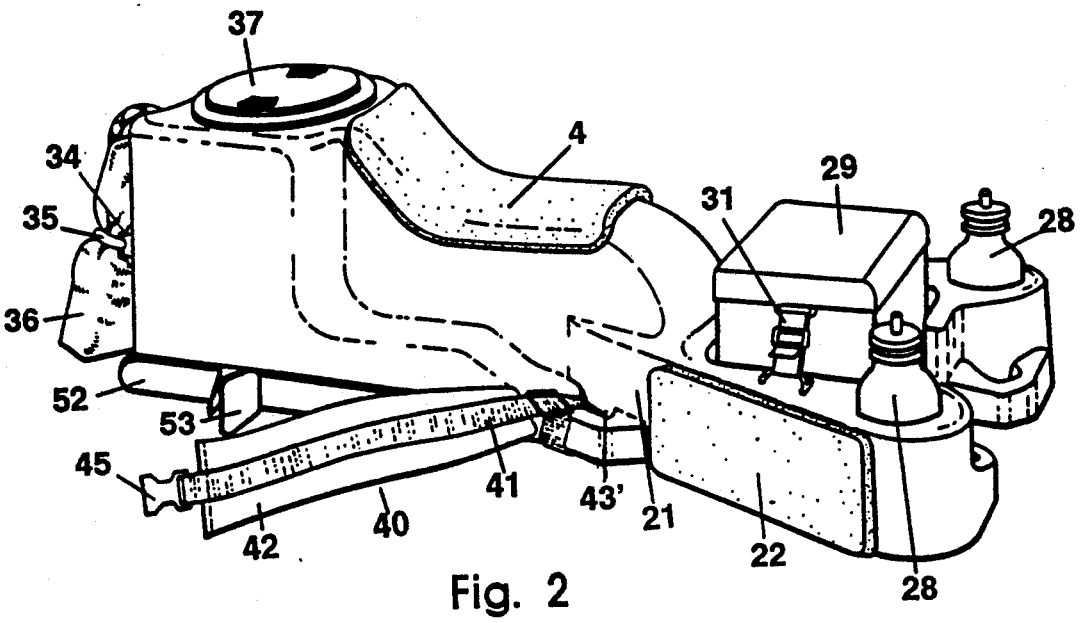
FIG. 2 is a perspective view of the saddle of the preferred embodiment showing accessories in place.

The flexibility and adjustable length of the straps allow them to securely hold the paddler in place yet be adaptable to paddlers of different sizes. Footbrace assemblies 51 of a type commonly used in kayaks are secured by screwing them to anchoring nuts 8 embedded along the lower edge of the saddle so that a paddler's feet may be securely braced to prevent any undesired rearward movement of the paddler. Suitable adjustable footbraces are commercially available, one such product such as that illustrated and well known in the art being known as "KEEPERS FOOTBRACES" from KEEPRS, P.O. Box. 2041, Easley, S.C. 29641, described in Masters, U.S. Pat. No. 4,942,840, issued Jul. 24, 1990. As seen in FIG. 2 the hollow saddle is stepped outwardly beneath its seat portion to provide straight flat side surfaces near the lower surface for mounting the footbrace assemblies and to facilitate molding of "eyes" 43 and 43' described below. Each footbrace assembly is provided with a track 52 which provides a plurality of selectable fixed positions for the brace portion 53, thereby providing longitudinal adjustability of the position of the footbrace 53 with respect to the saddle body 1. The combination of brace 53 behind the paddler's feet and thigh straps 40 over the forward portion of the paddler's legs anchors the paddler securely in place. This is further enhanced by the fact that the paddler straddles the main body of the saddle and his knees are firmly braced against opposite sides of the forward flared portion of the saddle. Although the paddler is firmly braced in this position he can easily release himself by loosening the thigh straps, by moving his feet away from the footbraces, by relaxing his legs to slip out of the thigh straps, or by a combination of these methods.

Figure 14:
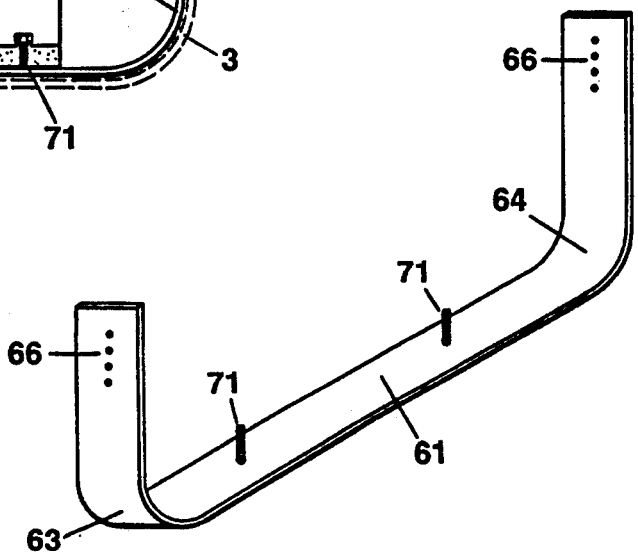
FIG. 14 is a perspective view of the spring securement strip anchoring means in a flexed configuration as it would appear in place within a canoe hull.
Figure 15:
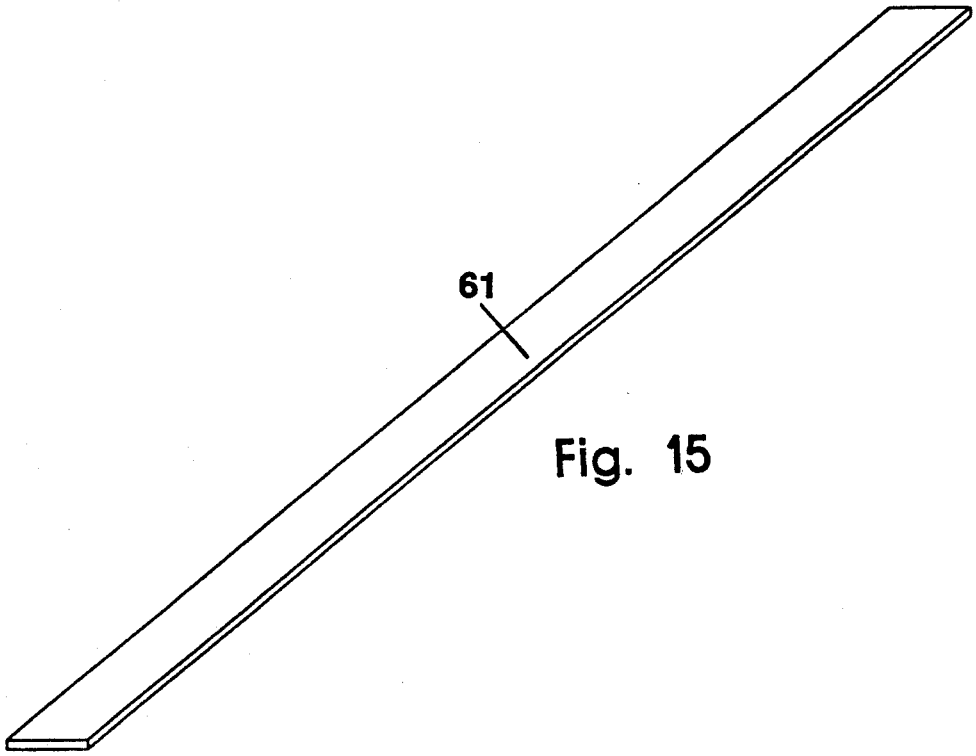
FIG. 15 is a perspective view of the spring securement strips means in an unflexed configuration as it would appear prior to being placed into a canoe hull.

The saddle body 1 is provided with "eyes" 43 and 43' molded in place near its lower surface to provide a means of securing one end of the thigh straps to the saddle and to provide several possible methods of securing the saddle into a craft as discussed below. The "eyes" 43 and 43' are attachment points for securing the saddle body to various devices on the hull floor area. As seen in FIGS. 3 and 7–9 these attachment points 43 and 43', as well as the attachment means in the form of tabs or projections 75 as in FIG. 8, are located only along an elongated narrow area of the lower base surface of the saddle body which rests on an elongated narrow area of the hyull floor area. These elongated narrow areas have a maximum width essentially equal to the spacing between the knees of a paddler in a kneeling paddling position straddling the saddle assembly. Such securement locations leave the hull floor area, and any saddle anchoring devices thereon as described hereinafter, exposed along opposite sides of the straddled portions of the saddle assembly and provide substantial room at either side of the saddle assembly to allow side-to-side trim adjustments. In the preferred embodiment, shown in cross section in FIG. 13, the saddle is secured to a pair of flexible spring strips 61 which are spaced apart longitudinally with respect to the craft. Each strip 61, which is relatively thin in comparison to its width (approximately 5/16 inch in depth and 4 inches wide), is formed from "Kydex" plastic, an alloy of acrylic and polyvinyl chloride (PVC) plastics. Each thin flexible resilient strip 61, which is relatively straight when unflexed or unstressed prior to installation in a craft, as shown in FIG. 15, is pressed downwardly into the craft to assume the flexed orientation shown in FIG. 14 so that ends of the strip extend from beneath the location of the saddle following the contour of the hull 3 outwardly and upwardly to be captured beneath the upper edges of the canoe at the gunnels 62. Each strip may have sufficient initial length to allow it to be properly fitted to any installation by trimming it to the particular length necessary required and fastened near its ends using a nut and bolt assembly 65. Mounted in this manner, each strip essentially forms an inverted arch shape and, since the ends are held downwardly, its resilience allows its outer surface 63, when flexed into a convex shape, to conform to a variety of shapes yet hold its shape and position. The inner flat concave surface 64 of the flexed strip provides points of attachment on the floor of the craft while the strip itself is fastened to the craft at only the ends of the strip. The flexible strips, when installed, provide the additional benefit of stiffening the hull and preventing "oilcanning", the tendency of the hull to flex upward under the force of water pressure on the exterior of the submerged portion of the hull when the craft is afloat.

Thus, a single saddle can be mounted in different positions in the same canoe and in canoes of varying widths and hull shapes without requiring any significant modification of the anchoring strips themselves. The ends of a strip are held in place by securing them near the gunnels by any of a variety of methods. For maximum security a strip is bolted in place by bolts 65 which pass through both the hull 3 and the ends of the strips. In order to allow easy removal, installation and adjustment of the spring strips, their ends can secured by using a suitable a hook and loop fastener such as that known by the trademark "VELCRO," with one of a pair of mating swatches of the fastener adhered or otherwise affixed to the outer surface of the spring strips and the other adhered to the inside surface of the hull.

Figure 10:
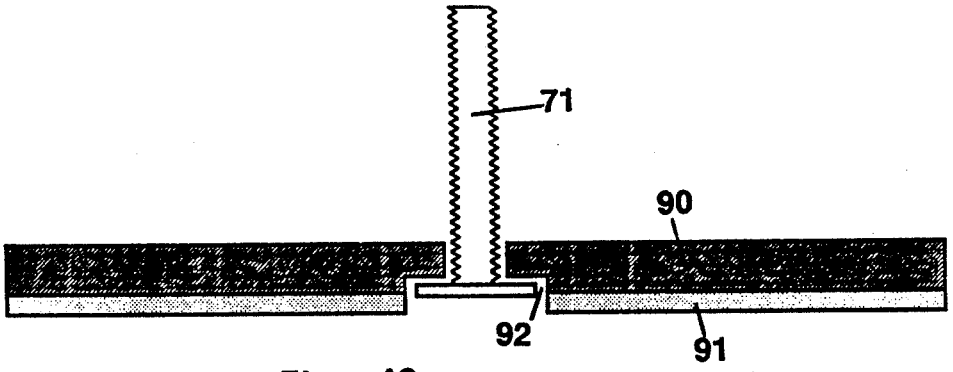
FIG. 10 is a cross-sectional view of a slotted plate and bolt anchoring means of securing the saddle into a craft.
Figure 12:
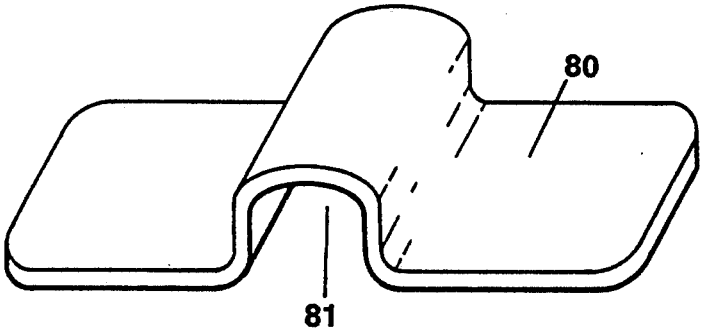
FIG. 12 is a perspective view of a fixed yoke anchoring means of securing a the saddle into a craft.

The saddle itself is fastened to the spring strips by means of threaded "toilet" bolts 71 or other threaded members extending upwardly through holes or apertures in the strips and through the flat bottom surface of the saddle into its hollow interior where each is secured with a corresponding nut and metal washer along with a rubber washer which seals the bolt opening into the bolt opening in the saddle against entry of water. As shown in FIG. 10 in conjunction with an alternative means of anchoring a saddle assembly, each toilet bolt has a broad flat head with a thickness of only approximately 0.1 inch, eliminating the need to provide additional space below the spring strips which would be required to accommodate the thickness of the head of an ordinary bolt. Each spring strip may be provided with a plurality of apertures 66 located near the ends of the strip and along its length to allow the strip to be effectively adjustable in length to accommodate differing distances between the gunnels along the interior surface of a hull. Similarly, numerous apertures may be provided along a strip to allow for varying the position of the toilet bolts 71 in relation to the strip or the hull itself when the strip is in position. The bolts 71 may also pass through the eyes 43 or 43' molded into the saddle and be secured by large washers or other suitable stopper large enough to prevent its passing through the eye. At least one end of the saddle may also be fitted with an external tab or tabs 75 as shown in FIG. 8 specifically for the purpose of providing an anchoring means on the exterior of the saddle to avoid the necessity of having bolts pass into the watertight compartment of the saddle. Such tabs would be slidably engageable with the tunnel-like portion 81 of an "omega" shaped anchor loop 80 shown in FIG. 12. This loop is constructed from a flat straight strip of Kydex plastic, heated to approximately 350 degrees F. and formed to the desired shape which it retains permanently upon being cooled to normal ambient temperature. This loop is securely affixed to the floor of the hull of the craft preferably through use of a suitable waterproof adhesive or may be made more readily removable by attachment directly to a spring strip 61. Because these anchor loops are constructed of the same material used for the preferred embodiment of the spring strips, an integrated structure may also be constructed in which one or more portions of a spring strip are permanently formed into such an omega shaped tunnel-like structure for receiving tabs or projections 75 from a saddle body. A structure formed in this manner would simultaneously serve the purposes of both an anchor loop and a spring strip as described.

Figure 17:
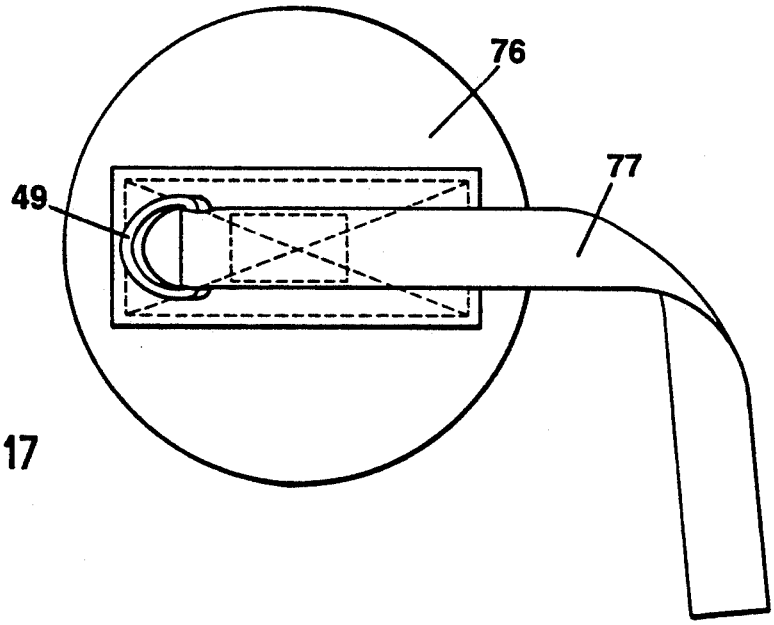
FIG. 17 is a plan view of a PVC patch with a strap and double D-ring assembly used to secure the saddle into a craft.

The "eyes" or apertures 43 and 43' incorporated into the saddle body 1 near its bottom surface as shown may be engaged ty adjustable strap loops 77 or 77' of nylon webbing or other suitable material. An end of the short length of webbing is passed through the eye and secured by means of a commonly used double D-ring assembly 49 attached to the other end of the strap, allowing the strap to be tightened and secured through the eye. Such straps are attached to patches 76 and 76' of cloth-reinforced PVC (vinyl) material, either permanently by sewing, or releasably, as shown in FIGS. 17 and 18 respectively. These PVC patches 76 and 76' are permanently adhered to the floor of the canoe with a suitable waterproof adhesive. To achieve fore and aft as well as side to side trim adjustment of the saddle when using the patches 76 and 76', rather than using strips 61 with multiple apertures therein for adjustably positioning the saddle securing bolts 71 as referred to above, multiple patches may be fixed at selected points on the hull floor area to provide anchoring means to anchor the saddle body in various positions for trim adjustments as well as to secure gear on the hull floor.

Figure 11:
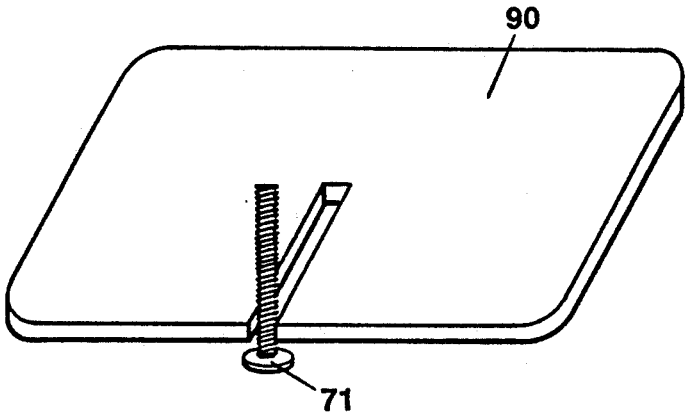
FIG. 11 is a perspective view of a slotted plate anchoring means of securing a saddle into a craft.

In another variation, the slotted plate 90 of Kydex material shown in FIGS. 10 and 11 is permanently secured to the floor of the craft using a suitable adhesive. The security of the adhesion of the plate to the floor may be enhanced by adhering a thin layer 91 of flexible plastic foam or neoprene material to the underside of the plate, as shown in cross section in FIG. 10, to provide contact and adhesion over the greatest possible surface area between the plate and the floor even in the presence of minor irregularities or curvature of the floor surface. The underside of the plate is provided with a recess 92 just slightly greater in depth than the thickness of the head of the toilet bolt 71, which is used to secure the saddle in the same manner as described above for the use of the spring strips. When a saddle is not in place the fastening bolts 71 are easily slid out of the slot and removed leaving only the flat surface of the plate exposed inside the craft without any bothersome protrusions.

The overall length of the saddle of FIGS. 1 through 4 is about 36 inches. The flat top where the sealed storage access opening is located is 12 inches high and comprises about one third of the length, the seat portion about 10 inches in length and the flared portion about 14 inches. The saddle width along the base behind the flared portion is 9 inches. The greatest width across the flared portion is about 18 inches. The seat portion is 8 inches high and its width above the step where the footbrace assembly is mounted is about 6 inches. The bottle wells are 3 inches in diameter and the dry-box well is 6½ by 9 inches. The thickness of the various walls of the saddle body is about 0.15 inches and is slightly thicker at where two intersecting surfaces meet. The diameter of the round reinforced PVC patches is approximately 6 inches.

Other variations within the scope of this invention will be apparent from the described embodiment and it is intended that the present descriptions be illustrative of the inventive features encompassed by the appended claims.

What is claimed is:

1. An accessory saddle assembly for attachment to an existing watercraft with a structurally complete open hull of predefined shape and having a floor area, said saddle assembly comprising a substantially watertight buoyant hollow saddle body with an interior and an exterior and an upper surface and a lower base surface, said lower surface being the surface upon which said saddle body rests, said upper surface being provided with a seat portion for a paddler astride the saddle assembly in a kneeling paddling position on said floor area in said hull, releasable securement means for releasably securing the lower surface of the body of said saddle assembly to an anchoring means secured at the floor area to the hull of the watercraft, said releasable securement means being located only near said lower base surface of said saddle body and at said floor area and only along an elongated narrow area of said lower surface for releasable attachment of said body to said hull, said elongated narrow area of said lower surface having a maximum width along the straddled portions of the length of the saddle assembly essentially equal to the spacing between the knees of the paddler astride the saddle assembly in said kneeling position leaving the floor area of the watercraft exposed at opposite sides of said elongated narrow area along said straddled portins of the saddle assembly so as to provide substantial room at either side of said saddle assembly enabling said securement means to anchored said body in different fore-to-aft or side-to-side trim positions in said hull dependent only on the position of said anchoring means at the floor area of said hull.

2. A saddle assembly according to claim 1 wherein said body is rotationally molded from a plastic material.

3. A saddle assembly according to claim 1 wherein said securement means enables the saddle assembly to be removably secured to said water craft.

4. A saddle assembly according to claim 1 wherein said securement means provides for adjustable longitudinal positioning of the saddle assembly with respect to the craft.

5. A saddle assembly according to claim 1 wherein said saddle assembly is provided with braces against which a paddler's feet can be braced, the position of said braces being longitudinally adjustable with respect to said body.

6. A saddle assembly according to claim 1 wherein said saddle assembly is provided with straps at opposite sides thereof for passing over the thighs of a paddler, each said strap having a first and a second end, said straps being adjustable in length, means for securing each first end to said saddle assembly, means for securing each second end to said hull.

7. A saddle assembly according to claim 1 further comprising a sealable opening with a removable sealing closure therein to provide access to the interior of said saddle body.

8. A saddle assembly according to claim 7 wherein said sealable opening faces upwardly and is located upon said upper surface.

9. A saddle assembly according to claim 8 wherein said sealable opening is located just behind and above said seat portion.

10. A saddle assembly according to claim 1 in which said securement means comprises threaded members adapted to be secured to the hull of the craft and extending upwardly from the hull to said lower base surface, and means for securing said threaded members to the hull.

11. A saddle assembly according to claim 10 in which said threaded members pass through said lower base surface and are secured within the interior of said saddle body.

12. A saddle assembly according to claim 1 wherein said saddle body is provided with recesses for holding or securing accessories.

13. A saddle assembly according to claim 12 wherein said recesses are upwardly opening and self-draining.

14. A saddle assembly accoridng to claim 1 wherein said saddle body includes at a lower portion thereof a widened forward portion which is flared outwardly in a lateral direction.

15. A saddle assembly according to claim 14 in which said flared portion provides substantially vertical surfaces which are spaced apart and against which a paddler's knees can be braced.

16. A saddle assembly according to claim 14 in which at least a portion of said lower base surface is widened to correspond to said flared portion, wherein said widened base surface provides substantial lateral stability to said saddle assembly, said flared portion being further provided with substantially vertical surfaces which are spaced apart and against which a paddler's knees can be braced.

17. A saddle assembly according to claim 14 wherein said flared portion is provided with recesses for securing equipment.

18. A saddle assembly according to claim 17 wherein said recesses are self-draining.

19. A saddle assembly according to claim 17 wherein a first recess is located laterally centrally of said flared portion for holding or securing a dry storage box, said first recess having two forward corners and two rearward corners and being essentially rectangular in shape, a second and a third recess, said second and third recesses each comprising a vertical generally cylindrical opening, positioned forwardly and outwardly from a respective forward corner of said rectangular recess at an angle of approximately 45 degrees.

20. A saddle assembly according to claim 1 in which at least a portion of said lower base surface is widened in comparison with the body width at seat portion, whereby said widened base surface can be braced against the hull to provide substantial lateral stability to said saddle assembly.

21. A saddle assembly according to claim 1 in which said lower base surface is covered over at least at most of its periphery with a layer of plastic foam material for supporting it on the hull, said foam material being capable of being formed to the shape of the hull of the craft.

22. A saddle assembly according to claim 1 wherein said securement means includes apertures molded into said saddle assembly and forming an integral part thereof, said apertures being engageable by straps secured to said hull for securing the saddle assembly thereto.

23. An accessory securement means for securing equipment such as a saddle or other object into an existing watercraft with a structurally complete open hull of predefined shape having sides and a floor area, said means being a separate structure attachable to and detachable from said hull with no change to the structural completeness of the hull and comprising one or more generally elongated strips of wide and relatively thin resilient material, each said strip having two ends and a central portion, each such strip being capable of being stressed to conform to the cross-sectional shape of the hull of said watercraft in a generally inverted arch shape, wherein each said strip includes means secured to opposite sides of said watercraft near the said ends of the strip with said central portion braced against the hull floor area, each said strip further comrpising means for fastening the saddle or other object to the central portion of said strip to anchor the object within the hull.

24. A securement means according to claim 23 in which the resilient strips are capable of being removably fastened to the hull.

25. A securement means according to claim 23 in which at least one such resilient strip is provided with at least one anchoring structures which is raised from the strip on the side of said strip opposite the hull of the watercraft when the resilient strip is in place against the hull floor area, each said structure providing means for securing at least part of said equipment to the strip.

26. A securement means according to claim 25 wherein said anchoring structure comprises a tunnel-like receiver for receiving a projection on said equipment which extends generally parallelto the hull floor area of the watercraft and securely retaining said projection against movement transversely of the receiver or away from the hull.

27. A securement means according to claim 23 in which each such spring strip is essentially flat in its unstressed condition and is stressed to assume said arched shape.

28. A securement means according to claim 23 wherein each said strip includes means for securing it at its ends by bolts passing through apertures in said strip and the hull.

29. A securement means according to claim 23 wherein each said strip includes means for securing it at its ends to the hull by a cooperating two part hook and loop fastening means where a first said part is affixed to the strip and the second said part is affixed to the hull of the craft.

30. A means for securement to a structurally complete open hull of an existing watercraft having a hull floor area, said hull having a pair of upper edges, said means comprising at least one elongated resilient spring strip with attachment means whereby an object may be secured to a longitudinally central portiion of the strip which extends across said floor area and wherein said strip is capable of conforming to the shape of the hull and is in contact with the hull over substantially the full length of said strip, the ends of each said strip extending from the center of the hull outwardly and upwardly from said central portion and including anchoring means to be captured beneath the respective upper edges of the watercraft hull near the gunnels to releasably anchor said strip to said hull.

31. A securement means according to claim 30 for securing a saddle into a watercraft with an open hull, comprising at least two said strips spaced at points along the length of the watercraft.

32. Securement means according to claim 30 for securing a saddle into a watercraft with an open hull, comprising at least two said strips spaced at points along the length of the watercraft, wherein at least one of said strips includes means for secufring it to said saddle at at least two points which are laterally spaced apart.

* * * * *